US011586131B2

(12) United States Patent
Hashimoto et al.

(10) Patent No.: US 11,586,131 B2
(45) Date of Patent: Feb. 21, 2023

(54) IMAGE FORMING APPARATUS WITH GUIDING MEMBER CONFIGURED TO GUIDE RECORDING MATERIAL AND BEING FIXED TO HOLDING MEMBER CONFIGURED TO HOLD ROLLER

(71) Applicant: CANON KABUSHIKI KAISHA, Tokyo (JP)

(72) Inventors: Naoki Hashimoto, Chiba (JP); Yutaka Nishimura, Tokyo (JP); Shoko Fujiwara, Ibaraki (JP); Tadahisa Sugiyama, Ibaraki (JP); Atsushi Takada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/669,515

(22) Filed: Feb. 11, 2022

(65) Prior Publication Data

US 2022/0269194 A1 Aug. 25, 2022

(30) Foreign Application Priority Data

Feb. 25, 2021 (JP) ..... JP2021 -028188
Jan. 31, 2022 (JP) ..... JP2022-013257

(51) Int. Cl.
*G03G 15/16* (2006.01)

(52) U.S. Cl.
CPC ..... *G03G 15/1615* (2013.01)

(58) Field of Classification Search
CPC ..... G03G 15/165; G03G 15/6558; G03G 15/1605; G03G 15/1615; G03G 15/1625; G03G 15/1665; G03G 21/168
USPC ..... 399/121, 302, 308, 316, 317
See application file for complete search history.

(56) References Cited

U.S. PATENT DOCUMENTS

| | | | | |
|---|---|---|---|---|
| 5,682,576 | A | 10/1997 | Sakai et al. | |
| 5,824,408 | A | 10/1998 | Kume et al. | |
| 6,023,597 | A | 2/2000 | Mayuzumi | |
| 6,131,010 | A | 10/2000 | Kume et al. | |
| 7,080,835 | B2 | 7/2006 | Oikawa et al. | |
| 7,354,034 | B2 | 4/2008 | Nakamura et al. | |
| 7,543,806 | B2 | 6/2009 | Nakamura et al. | |
| 7,992,867 | B2 | 8/2011 | Okamoto et al. | |
| 8,824,954 | B2 | 9/2014 | Nishimura | |
| 9,517,906 | B2 | 12/2016 | Nishimura | |
| 9,557,688 | B2 * | 1/2017 | Tajiri | G03G 15/1665 |
| 9,896,291 | B2 | 2/2018 | Sugiyama | |

(Continued)

FOREIGN PATENT DOCUMENTS

JP 2016-170289 A 9/2016

OTHER PUBLICATIONS

Co-Pending U.S. Appl. No. 17/669,499.

*Primary Examiner* — William J Royer
(74) *Attorney, Agent, or Firm* — Venable LLP

(57) ABSTRACT

An image forming apparatus includes an endless image bearing belt, a first roller, a second roller, a rotatable member, a holding member, a feeding unit, and a guiding member. The guiding member is provided on a side downstream of the feeding unit and upstream of a transfer nip with respect to a recording material feeding direction at a position opposing a stretching portion stretched by the first roller and the second roller of the image bearing belt and guides a recording material, to the transfer nip, fed by the feeding unit. The guiding member is fixed to the holding member.

10 Claims, 13 Drawing Sheets

(56) References Cited

U.S. PATENT DOCUMENTS

| | | | |
|---|---|---|---|
| 10,948,855 | B2 | 3/2021 | Sugiyama |
| 2009/0162116 | A1 | 6/2009 | Mogi et al. |
| 2019/0039848 | A1 | 2/2019 | Sugiyama |
| 2022/0269193 | A1* | 8/2022 | Nishimura et al. ..... G03G 15/1615 |

* cited by examiner

IMAGE FORMING APPARATUS WITH GUIDING MEMBER CONFIGURED TO GUIDE RECORDING MATERIAL AND BEING FIXED TO HOLDING MEMBER CONFIGURED TO HOLD ROLLER

FIELD OF THE INVENTION AND RELATED ART

The present invention relates to an image forming apparatus, such as a printer, a copying machine, a facsimile, or a multi-function machine, using electrophotography.

Conventionally, in order to form an image on a recording material, an image forming apparatus of an intermediary transfer type has been used. In the image forming apparatus of the intermediary transfer type, a toner image formed on a photosensitive drum is transferred onto an intermediary transfer belt in response to application of a primary transfer voltage. Thereafter, when a strong electric field is generated in response to application of a secondary transfer voltage in a transfer nip formed by an inner secondary transfer roller and an outer secondary transfer roller which are provided while sandwiching the intermediary transfer belt therebetween, the toner image on the intermediary transfer belt is transferred onto a recording material passing through the transfer nip. The recording material onto which the toner image is to be transferred is fed toward the transfer nip, and is controlled in attitude and guided by a pair of an inner guiding plate and an outer guiding plate which are disposed on a side upstream of the transfer nip with respect to a recording material feeding direction (Japanese Laid-Open Application (JP-A) 2016-170289).

In the case of an apparatus disclosed in JP-A 2016-170289, the outer guiding plate is provided in a transfer feeding unit rotatably supported by a supporting frame, and the inner guiding plate is fixed to the supporting frame so as to form one surface of a recording material feeding path between itself and the outer guiding plate. That is, the outer guiding plate is capable of being contacted to and separated from the intermediary transfer belt and the inner guiding plate in response to rotation of the transfer feeding unit. Further, the transfer feeding unit is provided with a pressing unit (pressing member) for rotating and positioning the outer guiding plate in order to form an interval (gap), appropriate for the toner image transfer, between the outer guiding plate and the intermediary transfer belt. The outer guiding plate is supported by the transfer feeding unit via the pressing unit. This is because in the case where the interval between the outer guiding plate and the intermediary transfer belt is not appropriate, when the recording material enters the transfer nip, an entrance angle is not stabilized and the recording material flutters and thus there is a liability that improper transfer such that the toner image is not properly transferred is caused to occur. Particularly, the improper transfer is liable to occur when the outer guiding plate is provided at a position spaced from the intermediary transfer belt.

However, conventionally, there was a liability that the outer guiding plate is not disposed at a position where the outer guiding plate is capable of forming the interval appropriate for the toner image transfer relative to the intermediary transfer belt since the outer guiding plate and the intermediary transfer belt are disposed on separate units by way of many component parts. That is, each of the supporting frame, the transfer feeding unit, and the pressing unit can cause component (part) tolerance. Therefore, a relative positional relationship between the intermediary transfer belt and the outer guiding plate which are mounted to the respective units is influenced by the component tolerances of the respective units. If so, for each of individual image forming apparatuses, there is a liability that in a state in which the outer guiding plate is spaced from the intermediary transfer belt in a distance more than an appropriate interval, the outer guiding plate is disposed relative to the intermediary transfer belt.

SUMMARY OF THE INVENTION

The present invention has been accomplished in view of the above-described problem. A principal object of the present invention is to provide an image forming apparatus in which an outer guiding plate for guiding a recording material to a transfer nip is capable of being provided at a position where an interval appropriate for toner image transfer is formed between the outer guiding plate and an intermediary transfer belt.

According to an aspect of the present invention, there is provided an image forming apparatus comprising: an endless image bearing belt rotatable while bearing a toner image transferred from an image bearing member; a first roller configured to stretch the image bearing belt; a second roller provided on a side upstream of the first roller with respect to a rotational direction of the image bearing belt and configured to stretch the image bearing belt in cooperation with the first roller; a rotatable member configured to form a transfer nip in which the toner image on the image bearing belt is transferred onto a recording material while nipping and feeding the recording material in cooperation with the first roller through the image bearing belt; a holding member configured to rotatably hold the second roller at opposite end portions with respect to a rotational axis direction of the second roller; a feeding unit configured to feed the recording material toward the transfer nip; a guiding member which is provided on a side downstream of the feeding unit and upstream of the transfer nip with respect to a recording material feeding direction at a position opposing a stretching portion stretched by the first roller and the second roller of the image bearing belt and which is configured to guide the recording material, to the transfer nip, fed by the feeding unit; and wherein the guiding member is fixed to the holding portion.

Further features of the present invention will become apparent from the following description of exemplary embodiments with reference to the attached drawings.

Figure 5:
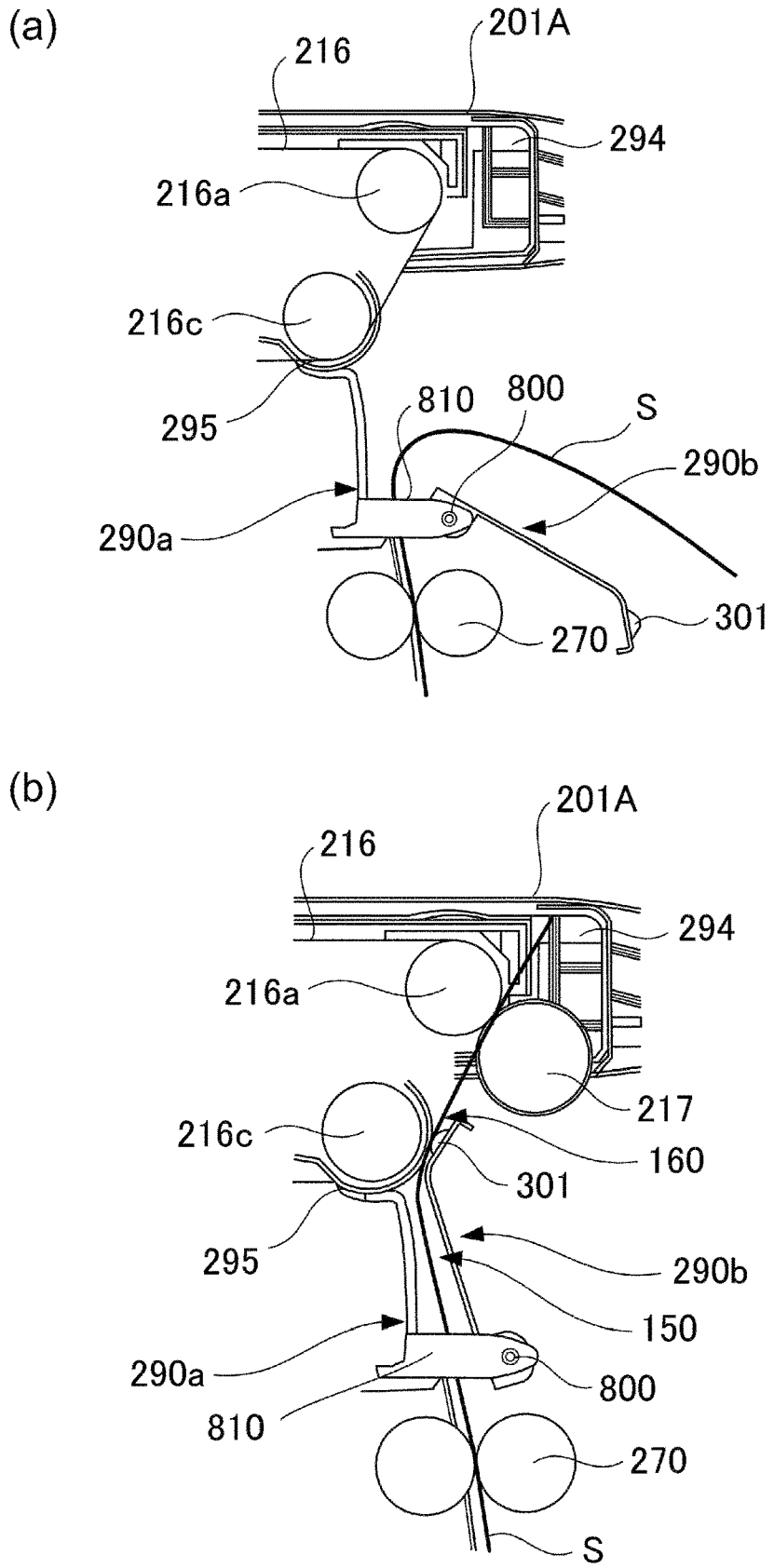

Parts (a) and (b) of FIG. 5 are side views showing an outer guiding plate, an inner guiding plate, and a bearing in a second embodiment, in which part (a) shows the case where the outer guiding plate is in an open position, and part (b) shows the case where the outer guiding plate is in a closed position.

Figure 6:
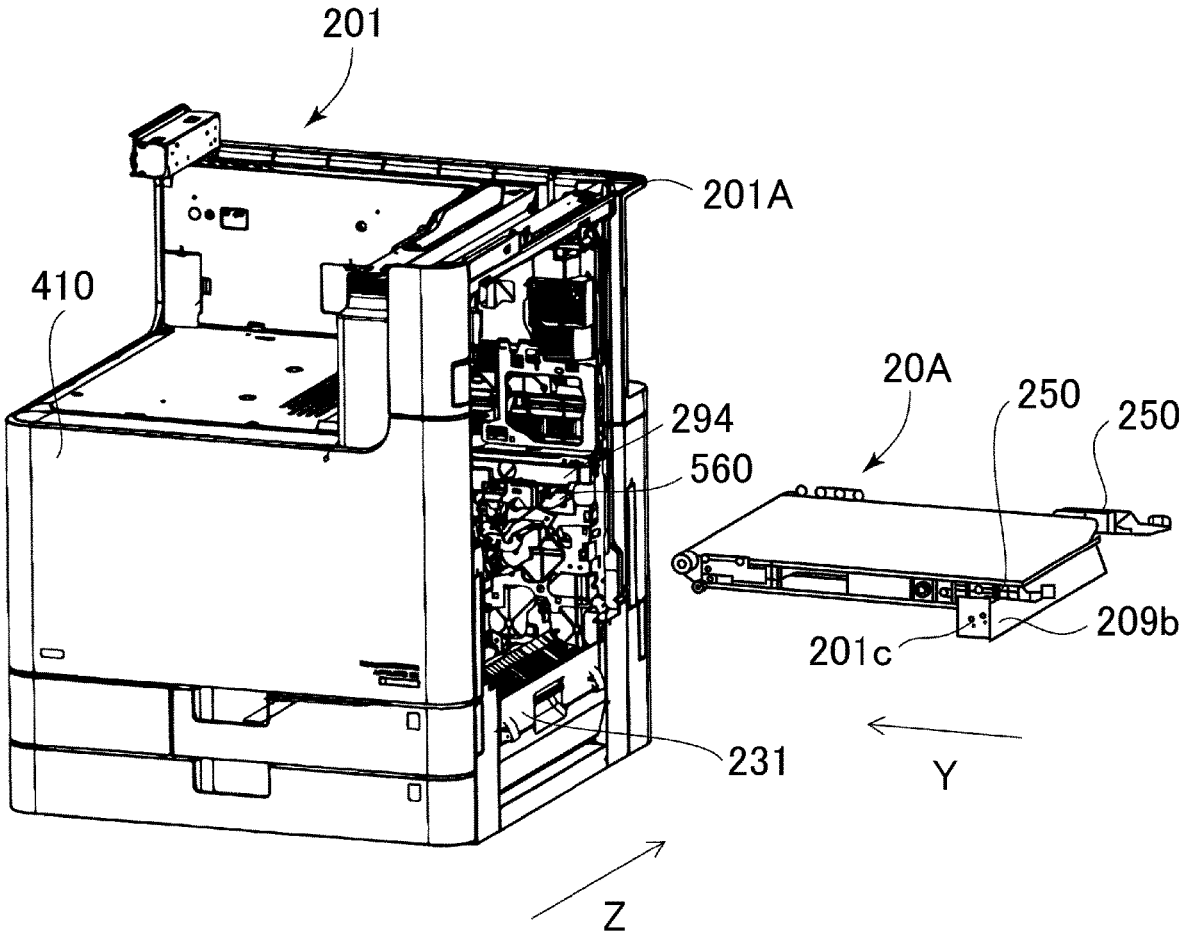

FIG. 6 is a perspective view showing an intermediary transfer unit of a third embodiment.

Figure 7:
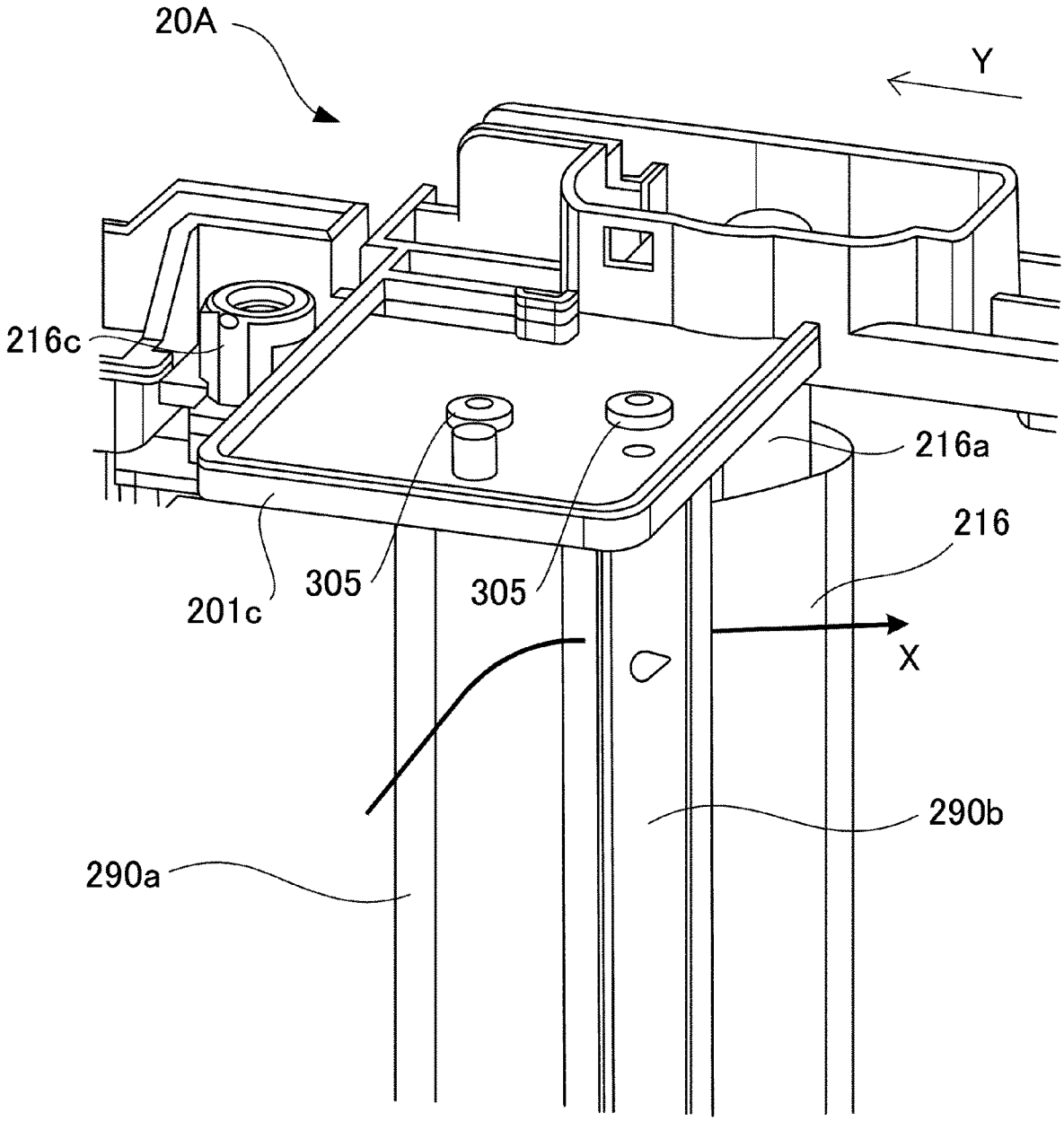

FIG. 7 is an enlarged view showing a part of the intermediary transfer unit in an enlarged manner.

Figure 8:
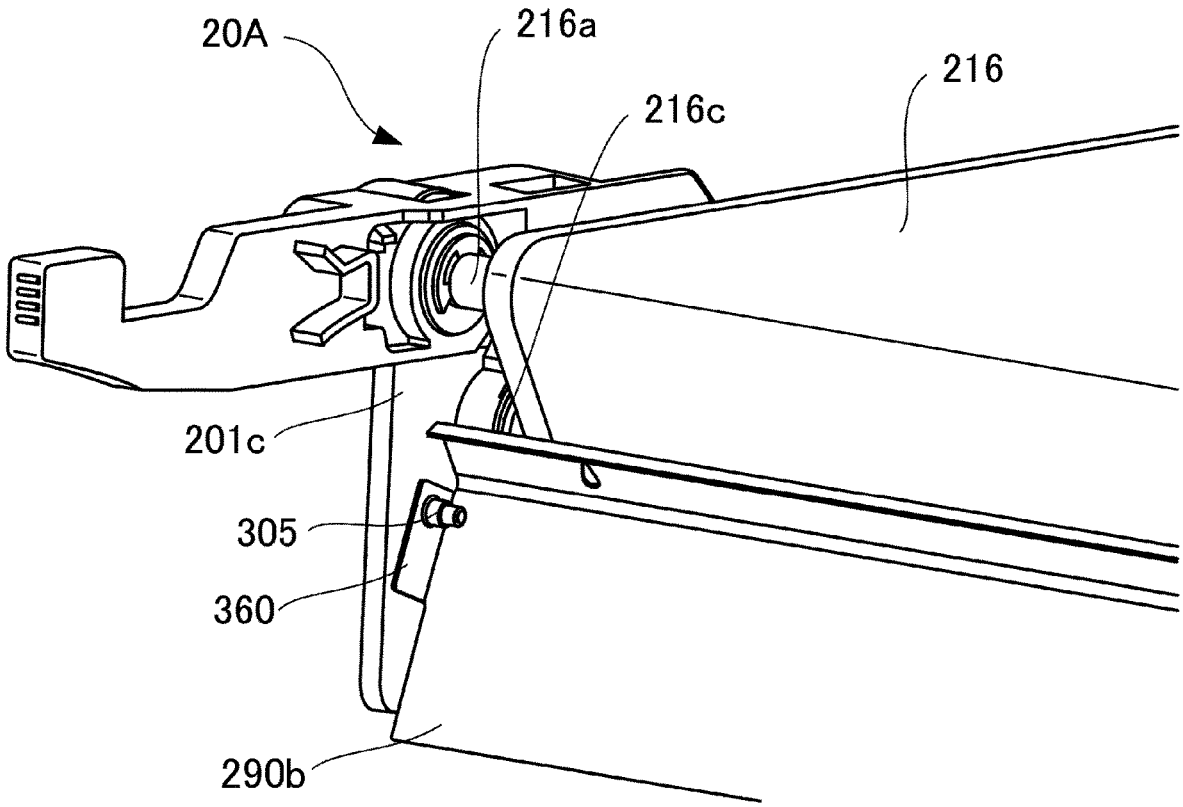

FIG. 8 is an enlarged view showing a fixing state of an outer guiding plate in the intermediary transfer unit.

Figure 9:
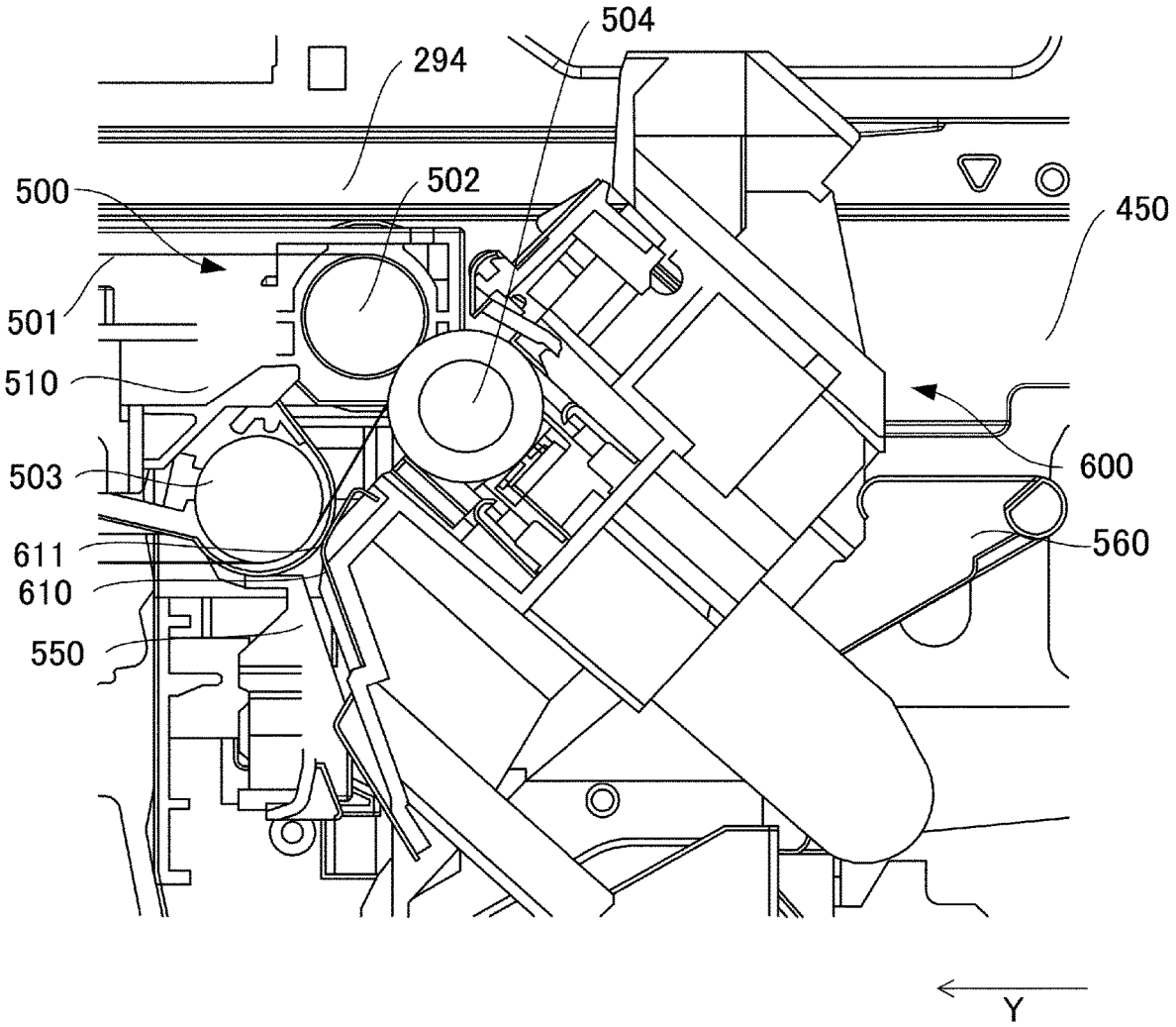
Fig. 9 PRIOR ART

FIG. 9 is a sectional view showing a conventional example.

Figure 10:
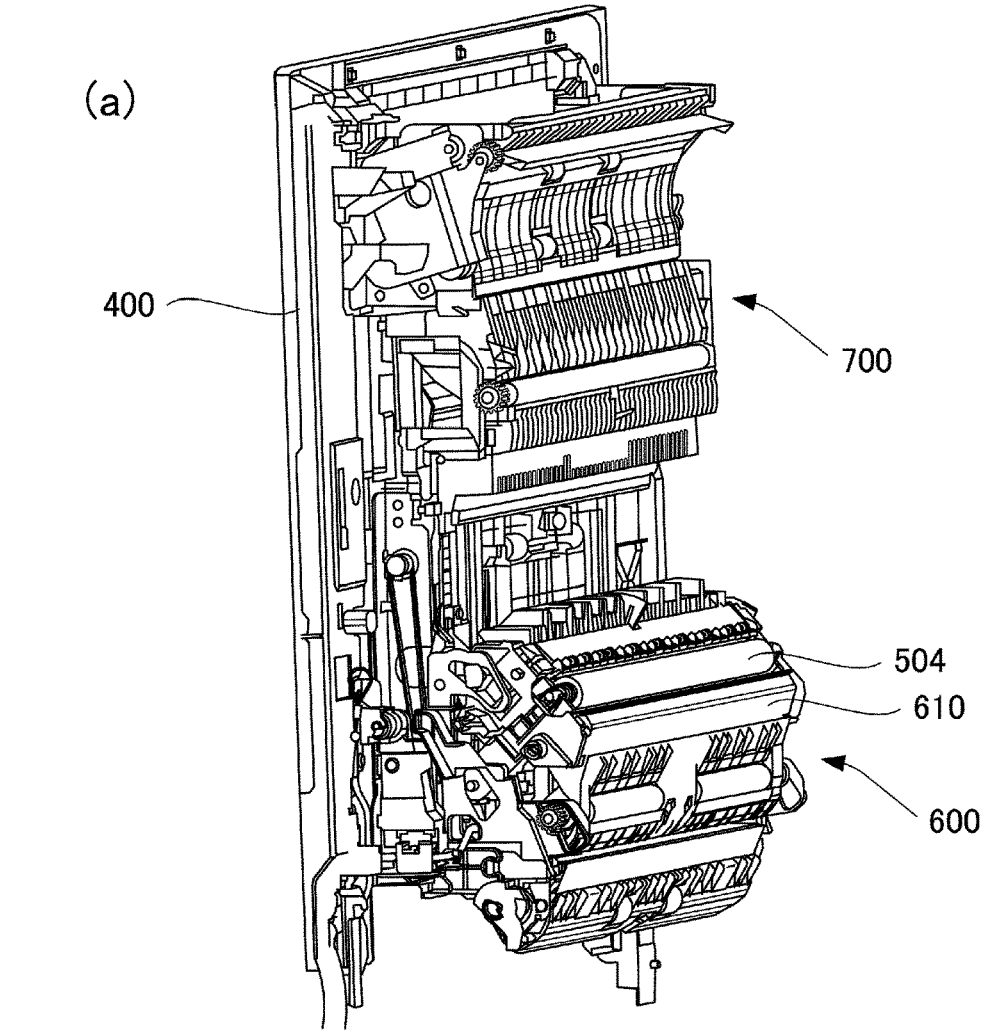
Fig. 10 PRIOR ART
Figure 10:
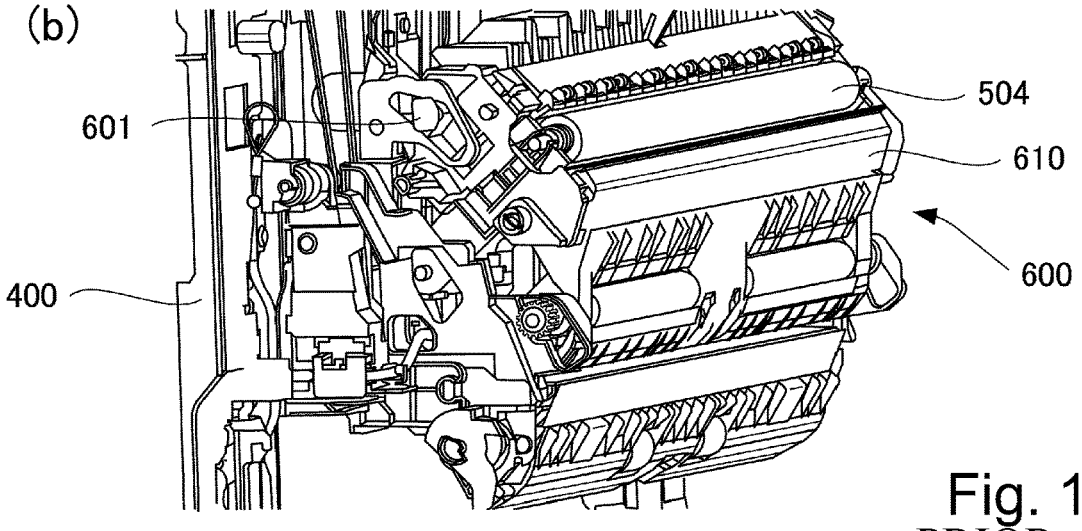
Fig. 10 PRIOR ART

Part (a) of FIG. 10 is a perspective view showing a transfer feeding unit of the conventional example, and part (b) of FIG. 10 is an enlarged view showing the transfer feeding unit of the conventional example.

Figure 11:
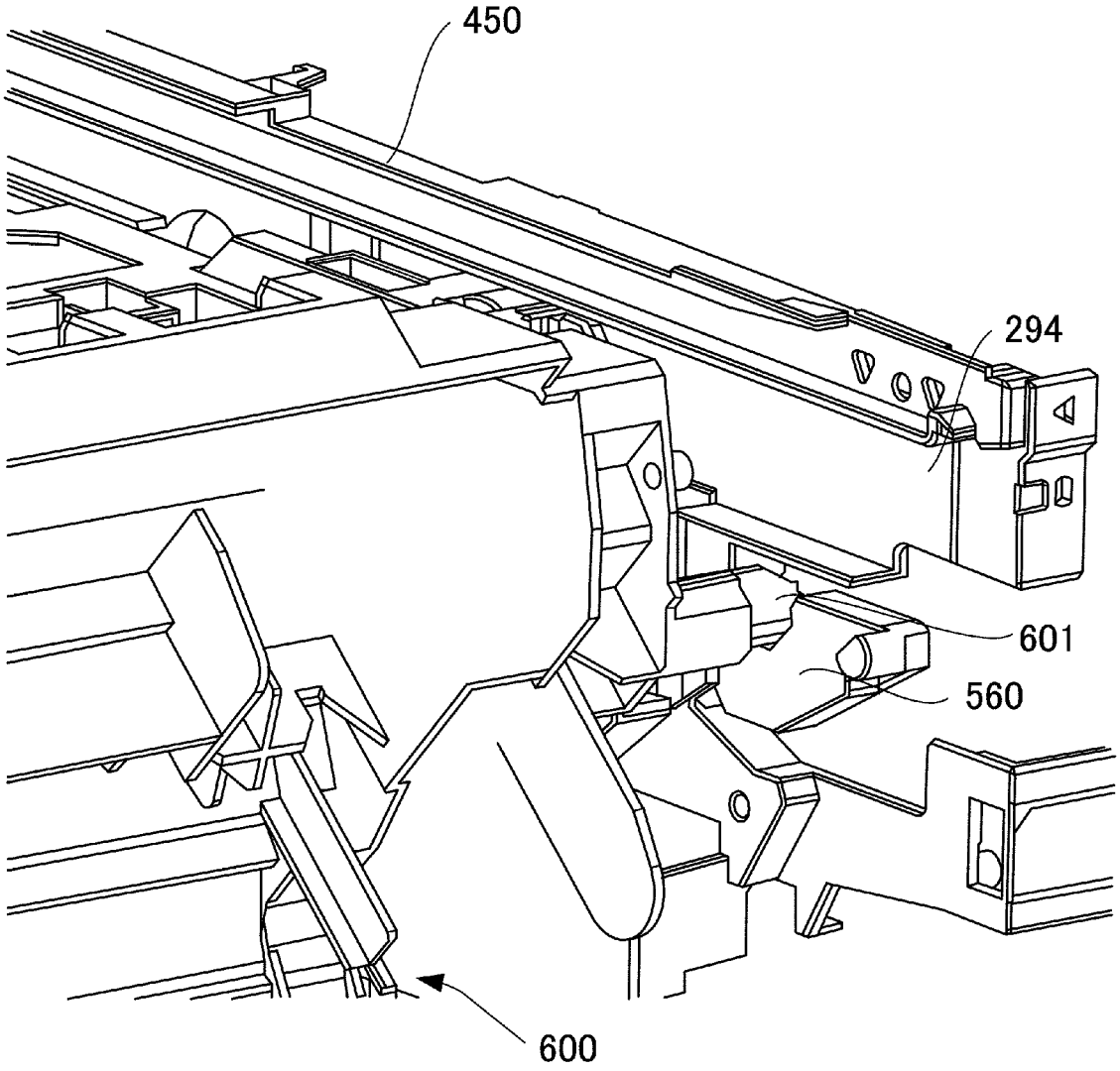
Fig. 11 PRIOR ART

FIG. 11 is an enlarged view showing a positioning state of the transfer feeding unit in the conventional example.

Figure 12:
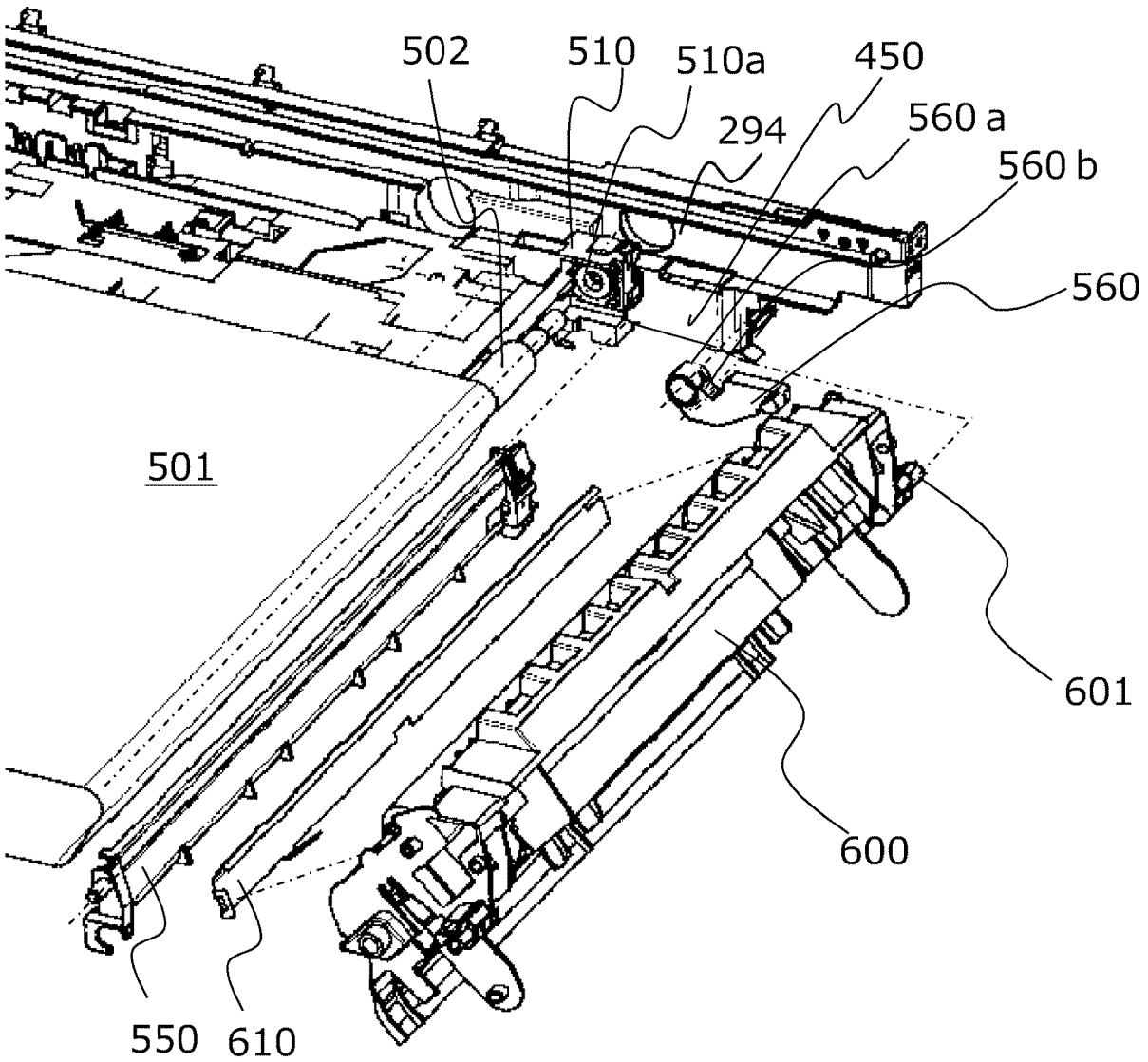
Fig. 12 PRIOR ART

FIG. 12 is an exploded perspective view showing a positioning constitution of the transfer feeding unit in the conventional example.

DESCRIPTION OF THE EMBODIMENTS

First Embodiment

<Image Forming Apparatus>

Figure 1:
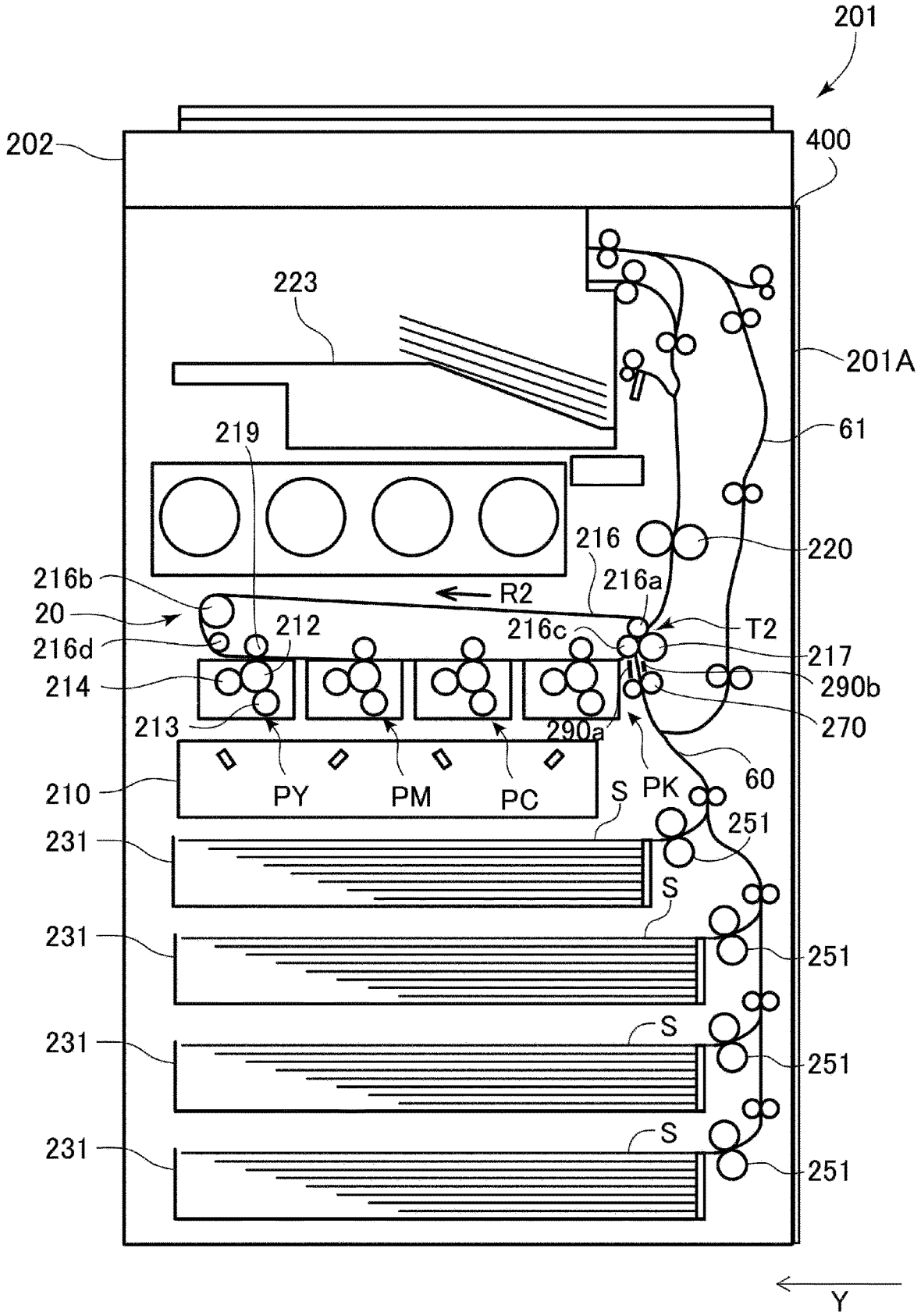
FIG. 1 is a schematic view showing a constitution of an image forming apparatus of a first embodiment.

An image forming apparatus of this embodiment will be described using FIG. 1. An image forming apparatus 201 shown in FIG. 1 is a full-color printer of an intermediary transfer type. The image forming apparatus 201 includes image forming portions PY, PM, PC and PK for forming toner images of yellow, magenta, cyan and black, respectively. The image forming apparatus 201 forms a toner image on a recording material S depending on an image signal from an original reading device 202 or an external device (not shown) such as a personal computer. As the recording material S, it is possible to cite a sheet material, such as a sheet, a plastic film, or a cloth.

As shown in FIG. 1, the image forming portions PY, PM, PC and PK are provided and arranged in a supporting frame 201A along a movement direction (arrow R2 direction) of an intermediary transfer belt 216 as an image bearing belt. The intermediary transfer belt 216 is an endless belt member for bearing and feeding the toner images primary-transferred from photosensitive drums of the respective image forming portions PY, PM, PC and PK. The intermediary transfer belt 216 is stretched by an inner secondary transfer roller 216*a* as a first roller, a tension roller 216*b*, a pre-secondary transfer roller 216*c*, and a driving roller 216*d*, and is moved in the belt movement direction R2 by the driving roller 201*d*. The pre-secondary transfer roller 216*c* as a second roller is provided rotatably on a side upstream of the inner secondary transfer roller 216*a* with respect to the belt movement direction R2, and stretches the intermediary transfer belt 216 in contact with an inner peripheral surface of the intermediary transfer belt 216.

An outer secondary transfer roller 217 as a rotatable member is provided so as to sandwich the intermediary transfer belt 216 in cooperation with the inner secondary transfer roller 216*a*, and forms a secondary transfer nip T2 where the toner images on the intermediary transfer belt (image bearing belt) 216 are secondary-transferred onto the recording material S. In the secondary transfer nip T2, the recording material S is nipped and fed by the inner secondary transfer roller 216*a* and the outer secondary transfer roller 217. Further, in response to application of a secondary transfer voltage to, for example, the outer secondary transfer roller 217 by an unshown high-voltage source, the toner images on the intermediary transfer belt 216 are transferred onto the recording material S.

In this embodiment, on a side upstream of a pair of these inner secondary transfer roller 216*a* and outer secondary transfer roller 217, an inner guiding plate 290*a* and an outer guiding plate 290*b* are provided.

The inner guiding plate 290*a* and the outer guiding plate 290*b* are provided for guiding the recording material S, fed by a registration roller pair 270, to the secondary transfer nip T2, the inner guiding plate 290*a* and the outer guiding plate 290*b* will be described later (see FIGS. 2A to 4). Incidentally, as regards, the inner guiding plate 290*a* and the outer guiding plate 290*b*, even when either one of the guiding plates is capable of performing a function depending on a bent state of the recording material S, such a guiding plate is called a "guiding plate" (guiding member) for guiding feeding of the recording material S in this embodiment.

Below the image forming apparatus 201, one to a plurality of cassettes 231 in which recording materials S are accommodated are provided. The recording material S accommodated in the cassette 231 are supplied one by one from the cassette 231 to a feeding path 60 by a feeding roller 251 in conformity to an image forming timing. The recording material S is fed to the registration roller pair 270 disposed in the feeding path 60, and is subjected to oblique movement correction and timing correction by the registration roller pair 270 as a feeding unit, and then is fed toward the secondary transfer nip T2.

The four image forming portions PY, PM, PC and PK provided in the image forming apparatus 201 have the substantially same constitution except that colors of toners used in developing devices 214 included therein are different from each other. Accordingly, herein, the yellow image forming portion PY will be described as a representative, and other image forming portions PY, PC and PK will be omitted from description. In the image forming portion PY, a photosensitive drum 212 as an image bearing member is provided. The photosensitive drum 212 is a photosensitive member rotationally driven by an unshown motor. At a periphery of the photosensitive drum 212, a charging device 213, the developing device 214, and a primary transfer roller 219 are provided.

In the case where an image forming operation is started, first, a surface of the rotating photosensitive drum 212 is electrically charged uniformly by the charging device 213. Then, the photosensitive drum 212 is subjected to scanning exposure with laser light emitted from an exposure device 210 (for example, a laser scanner) used in common with the image forming portions PY, PM, PC and PK. By this, an electrostatic latent image depending on the image signal is formed on the photosensitive drum 212. The electrostatic latent image formed on the photosensitive drum 212 is developed into a toner image by toner (developer) accommodated in the developing device 214.

The toner image formed on the photosensitive drum 212 is primary-transferred onto the intermediary transfer belt 216 in a primary transfer portion formed between the photosensitive drum 212 and the primary transfer roller 219 disposed while sandwiching the intermediary transfer belt 216 therebetween. At this time, to the primary transfer roller 219, a primary transfer voltage is applied. Thus, the intermediary transfer belt 216 is rotated while bearing the toner image transferred from the photosensitive drum 212.

The operation as described above is sequentially performed in the image forming portions PY, PM, PC and PK for yellow, magenta, cyan and black, so that the toner images are capable of being formed on the intermediary transfer belt 216. For example, a single-color toner image can be formed, and a toner image of a desired color can be formed by appropriately superposing toners of some of the four colors. In conformity to a formation timing of such a toner image, the recording material S supplied from the cassette 231 is fed to the secondary transfer nip T2 via the registration roller pair 270. Further, for example, a secondary transfer voltage is applied to the outer secondary transfer roller 217, whereby the toner images on the intermediary transfer belt 216 are secondary-transferred onto the recording material S during passing of the recording material S through the secondary transfer nip T2.

The recording material S on which the toner images are transferred from the intermediary transfer belt 216 is fed to a fixing device 220. In the fixing device 220, heat and pressure are applied to the recording material S while nipping and feeding the recording material S, whereby the toner images are fixed on the recording material S. In the case of an operation in a one-side printing mode in which the toner images are formed on one surface, the recording material S on which the toner images are fixed by the fixing device 220 is discharged onto a recording material stacking portion 223. On the other hand, in the case of an operation in a double-side printing mode in which the toner images are formed on both surfaces of the recording material S, after the toner images are formed on one surface by the fixing device 220, the recording material S is turned upside down by switch-back feeding and passes through a double-side (printing) feeding path 61, and then is fed toward the registration roller pair 270. Thereafter, the recording material S is subjected to a similar process as the process in the case of the operation in the one-side printing mode, so that the toner image is formed on the other surface by the fixing device 220, and then, the recording material S is discharged onto the recording material stacking portion 223.

In the case of this embodiment, the intermediary transfer belt 216, the inner secondary transfer roller 216*a*, the tension roller 216*b*, the pre-secondary transfer roller 216*c*, the driving roller 216*d*, a plurality of primary transfer rollers 219, the inner guiding plate 290*a*, and the outer guiding plate 290*b* form an intermediary transfer unit 20. The intermediary transfer unit 20 is provided so as to be inserted in and extracted from the supporting frame 201A. The intermediary transfer unit 20 is provided slidably in a mounting direction (arrow Y direction) in FIG. 1 along an ITB guiding rail 294 (see FIG. 3) provided on the supporting frame 201A, and is mounted in the supporting frame 201A while being guided by being slid (moved). The supporting frame 201A is provided with a door 400 which is openable and closable, and in a state in which the door 400 is opened, mounting and dismounting of the intermediary transfer unit 20 are capable of being carried out. In the case of this embodiment, the outer secondary transfer roller 217, a reverse path guide (see part (a) of FIG. 10 described later) for forming the double-side (printing) feeding path 61, and the like are mounted to the door 400, and the outer secondary transfer roller 217 is moved toward and away from the inner secondary transfer roller 216*a* in conformity to opening and closing of the door 400.

<Outer guiding plate and inner guiding plate>

Figure 2A:
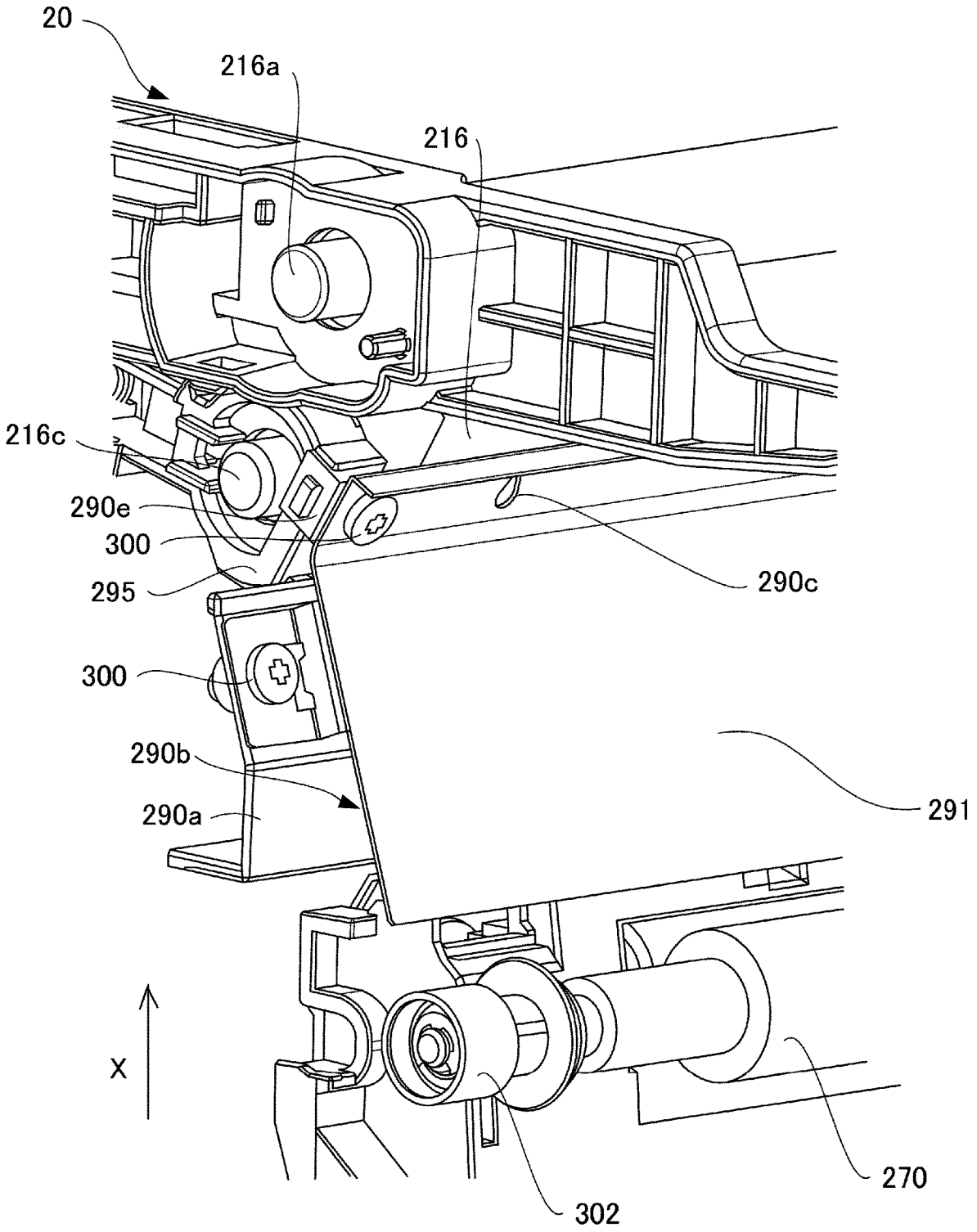
FIG. 2A is a perspective view showing an outer guiding plate, an inner guiding plate, and a bearing in the first embodiment.

Next, the outer guiding plate 290*b* and the inner guiding plate 290*a* will be described using FIGS. 2A to 4 while making reference to FIG. 1. As shown in FIG. 2A, a designation of sending the recording material S by the registration roller pair 270 is disposed so that the outer guiding plate 290*b* and the inner guiding plate 290*a* oppose to each other with an interval therebetween along a feeding direction (arrow X direction) of the recording material S. Each of the outer guiding plate 290*b* and the inner guiding plate 290*a* is a plate-like member formed with metal such as SUS (stainless steel) over a widthwise direction crossing the feeding direction X of the recording material S, in a width wider than a width of a feedable recording material S. The recording material S is sent to between the outer guiding plate 290*b* and the inner guiding plate 290*a* by the registration roller pair 270.

The inner guiding plate 290*a* and the outer guiding plate 290*b* guide the recording material S to the secondary transfer nip T2 while restricting a movement direction of the recording material S sent from the registration roller pair 270. The inner guiding plate 290*a* as a first guiding member guides one surface (transfer surface onto which the toner image is transferred from the intermediary transfer belt 216) of the recording material S so as to restrict motion such that the recording material S approaches the intermediary transfer belt 216. On the other hand, the outer guiding plate 290*b* as a second guiding member guides the other surface (surface opposite from the transfer surface) of the recording material S so as to restrict motion such that the recording material S is moved away from the intermediary transfer belt 216.

Figure 3:
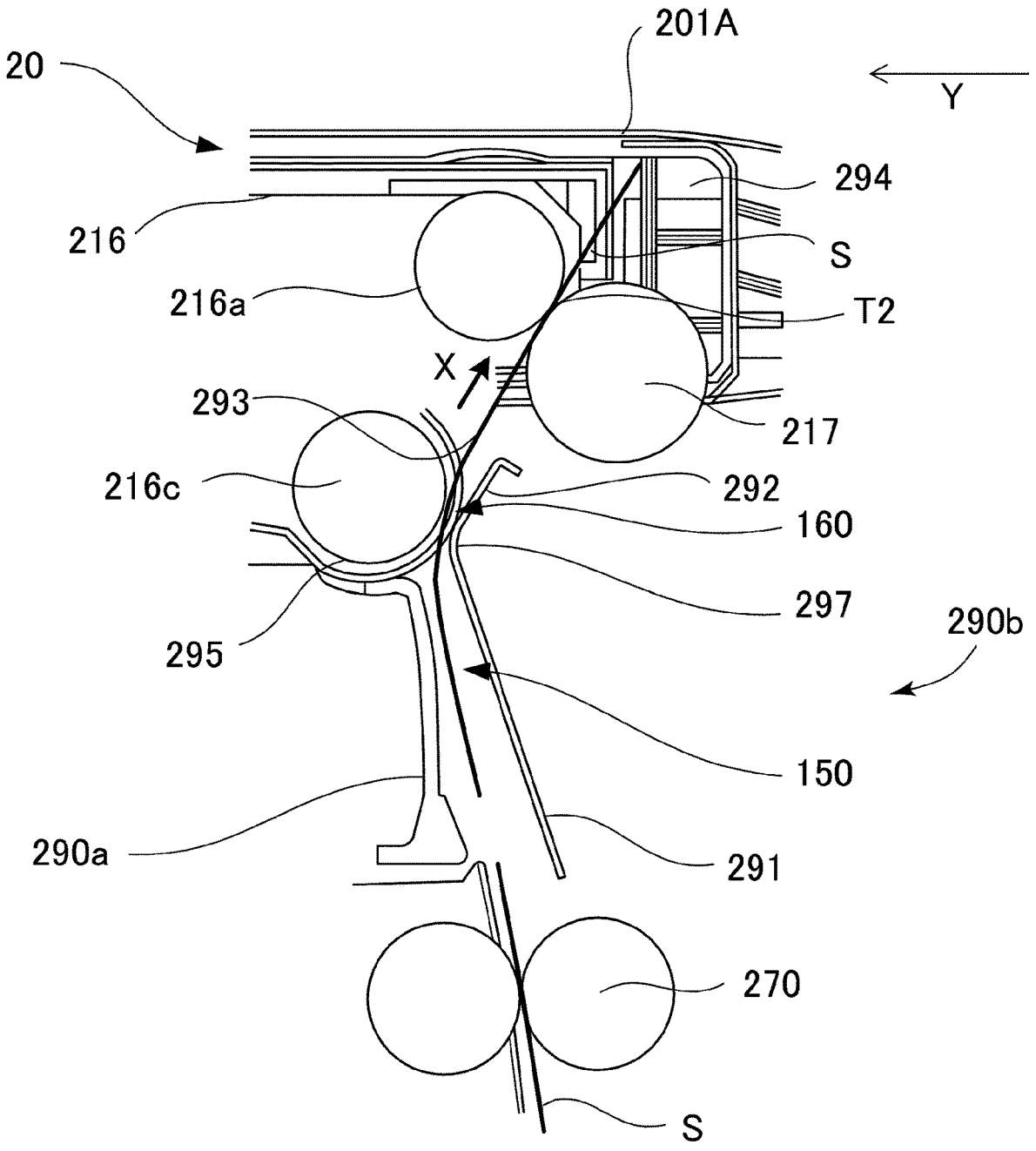
FIG. 3 is a side view showing the outer guiding plate, the inner guiding plate, and the bearing.

As shown in FIG. 3, the outer guiding plate 290*b* is formed in a shape such that the outer guiding plate 290*b* is bent at a bent portion 297 with respect to the feeding direction (appropriate X direction) of the recording material S. On a side upstream of the bent portion 297 of the outer guiding plate 290*b* with respect to the feeding direction X, an upstream guiding portion 291 opposing the inner guiding plate 290*a* is formed. The upstream guiding portion 291 as a first opposing portion guides the recording material S while restricting a feeding direction of the recording material S fed from the registration roller pair 270 and an entrance angle of the recording material S toward the bent portion 297. On a side downstream of the bent portion 297 of the outer guiding plate 290*b* with respect to the feeding direction X, a downstream guiding portion 292 which is continuous to the upstream guiding portion 291 and which opposes the intermediary transfer belt 216 (a stretching portion 293 stretched by the inner secondary transfer roller 216*a* and the pre-secondary transfer roller 216*c*) is formed. The downstream guiding portion 292 as a second opposing portion guides the recording material S while restricting an attitude of the recording material S when it enters the secondary transfer nip T2 and an attitude of the recording material S during passing through the secondary transfer nip T2.

Incidentally, in the case of this embodiment, the outer guiding plate 290*b* is disposed so that, a feeding path 150 formed by the upstream guiding portion 291 and the inner guiding plate 290*a* becomes narrow from an upstream toward a downstream. Further, the outer guiding plate 290*b* is disposed so that a feeding path 160 formed by the downstream guiding portion 292 and the intermediary transfer belt 216 becomes narrow from the upstream toward the downstream. <Conventional example>

Incidentally, the outer guiding plate 290*b* is used in pair with the inner guiding plate 290*a* or the intermediary transfer belt 216, so that a guiding function of the recording material S as described above is capable of being realized. Therefore, each of a positional relationship between the upstream guiding portion 291 and the inner guiding plate 290*a* and a positional relationship between the downstream guiding portion 292 and the intermediary transfer belt 216 has an influence on the feeding path (150, 160), so that the attitude of the recording material S fed to the secondary transfer nip T2 of the intermediary transfer belt 216 is capable of being changed.

Conventionally, the positional relationship between the upstream guiding portion 291 and the inner guiding plate 290*a* and the positional relationship between the downstream guiding portion 292 and the intermediary transfer belt 216 were liable to cause positional deviation due to the component tolerance. Therefore, the intervals of the feeding paths (150, 160) become narrow or broad and thus an interval such that the toner image is appropriately transferred is not provided, with the result that improper transfer onto the recording material S occurred. Particularly, on an upstream side of the secondary transfer nip T2, electric discharge is generated by broadening of the interval between the recording material S and the intermediary transfer belt 216, so that a charge polarity of the toner is reversed. By this, a part of the image is not transferred onto the recording material S, so that there was a liability that a phenomenon of a white void of the image as improper transfer occurs. In order to suppress this phenomenon, it is effective that on the upstream side of the secondary transfer nip T2, the recording material S and the intermediary transfer belt 216 are caused to move together. That is, it is known that narrowing of the interval between the outer guiding plate 290*b* and the intermediary transfer belt 216 is effective. The conventional example is shown in FIGS. 9 to 12. FIG. 9 is a sectional view showing the conventional example. Part (a) of FIG. 10 is a perspective view showing a transfer feeding unit of the conventional example, and part (b) of FIG. 10 is an enlarged view showing the transfer feeding unit of the conventional example. FIG. 11 is an enlarged view showing a positioning state of the transfer feeding unit in the conventional example. FIG. 12 is an exploded perspective view showing a positioning constitution of the transfer feeding unit in the conventional example.

As shown in FIGS. 9 and 12, in the case of the conventional example, an intermediary transfer unit 500 is provided so as to be capable of being inserted in and extracted from a supporting frame 450 in accordance with intermediary transfer belt guiding rails 294 provided on the supporting frame 450. The intermediary transfer unit 500 includes an intermediary transfer belt 501, an inner secondary transfer roller 502, a pre-secondary transfer roller 503, an unshown driving roller and an unshown plurality of primary transfer rollers (see FIG. 1), and a holding portion 510 for rotatably holding these rollers at opposite end portions with respect to a widthwise direction. In FIG. 12, only one end side of a roller shaft is shown, but the holding portion 510 is provided with a bearing portion 510*a* rotatably holding the inner secondary transfer roller 502. Further, an inner guiding plate 550 is fixed to the supporting frame 450. That is, the inner guiding plate 550 is provided separately from the intermediary transfer unit 500. Further, to the supporting frame 450, a lock lever 560 for locking a transfer feeding unit 600 described later is fixed. The lock lever 560 is rotatable about a shaft 560*a* relative to the supporting frame 450.

As shown in part (a) of FIG. 10, the transfer feeding unit 600 is provided together with a reverse path guide 700 forming the double-side (printing) feeding path 61 (see FIG. 1) along which the recording material S is reversed and fed, on a door 400 provided so as to be openable and closable relative to the door 400 (see FIG. 9). Further, as shown in part (b) of FIG. 10, the transfer feeding unit 600 is mounted on the door 400 so as to be swingable relative to the door 400 via an engaging portion 601. By this, in conformity to opening and closing of the door 400, the transfer feeding unit 600 is capable of moving toward and away from the intermediary transfer unit 500 or the inner guiding plate 550 (see FIG. 9). Incidentally, the door 400 is rotated about a lower side as a rotation center in part (a) of FIG. 10 relative to the supporting frame 450.

In response to a closing operation of the door 400, the engaging portion 601 of the transfer feeding unit 600 contacts a free end (on a side opposite from the rotation shaft 560*a*) of the lock lever 560 provided on the supporting frame 450. Then, the door 400 is closed in a state in which the engaging portion 601 abuts against the lock lever 560, so that the lock lever 560 is rotated about the shaft 560*a*. The door 400 is closed as it is, as shown in FIG. 11, the engaging portion 601 engages with a groove portion 560*b* (see FIG. 12) of the lock lever 560, so that the transfer feeding unit 600 stops and is positioned relative to the supporting frame 450. The transfer feeding unit 600 is supported by the door 400 so as to be swingable relative to the door 400 with play, and therefore, a positioning state by the lock lever 560 is maintained in a state in which the door 400 is locked by the supporting frame 450. That is, the transfer feeding unit 600 in the conventional example is positioned relative to the supporting frame 450 via the lock lever 560.

In the above-described transfer feeding unit 600, as shown in FIGS. 9 and 12, an outer secondary transfer roller 504 is provided rotatably and an outer guiding plate 610 is fixed on a side upstream of the outer secondary transfer roller 504 with respect to the feeding direction of the recording material S. The outer guiding plate 610 opposes the inner guiding plate 550 at an upstream guiding portion on a side upstream of a bent portion 611 with respect to the feeding direction in a closed state of the door 400 (i.e., in a state in which the transfer feeding unit 600 is positioned by the lock lever 560), and forms one surface of a feeding path of the recording material S with an interval between itself and the inner guiding plate 550. Further, the outer guiding plate 610 opposes the intermediary transfer belt 501 at a downstream guiding portion on a side downstream of the bent portion 611 with respect to the feeding direction in the closed state of the door 400, and forms one surface of the feeding path of the recording material S with an interval between itself and the intermediary transfer belt 501. In order to realize such a constitution, the transfer feeding unit 600 provided with the outer guiding plate 610 was disposed so as to be positioned relative to the inner guiding plate 550 and the intermediary transfer unit 500 supported by the supporting frame 450 via the lock lever 560 fixed to the supporting frame 450. That is, the outer guiding plate 610 was positioned relative to the intermediary transfer unit 500 and the inner guiding plate 550 via the transfer feeding unit 600, the lock lever 560, and the supporting frame 450.

In such a conventional example, there are many interposed component parts regarding the positioning of the outer guiding plate 610 and the intermediary transfer unit 500. For that reason, due to tolerances of the respective members, the interval (gap) between the intermediary transfer belt 501 and the outer guiding plate 610 is liable to become different, so that there was a liability that the above-described improper transfer is caused to occur. Particularly, on an upstream side of the secondary transfer nip T2 (in a stretching portion of the intermediary transfer belt 501 where the intermediary transfer belt 501 is stretched by the inner secondary transfer roller 502 and the pre-secondary transfer roller 503), electric discharge is generated by broadening of the interval between the recording material S and the intermediary transfer belt 501, so that the charge polarity of the toner is reversed. By this, a part of the image is not transferred onto the recording material S, so that there was a liability that a phenomenon of a white void of the image as improper transfer occurs. Therefore, in this embodiment, as described hereinbelow, at a position where an interval appropriate for transfer of the toner image is formed between the outer guiding plate 290*b* and the intermediary transfer belt 216, the outer guiding plate 290*b* was capable of being positionally disposed relative to the intermediary transfer belt 216. In the following, a positioning constitution of the outer guiding plate 290*b* relative to the intermediary transfer belt 216 will be described.

<Positioning Constitution of Outer Guiding Plate Relative to Intermediary Transfer Belt>

As shown in FIG. 3, the inner guiding plate 290*a* is fixed at a position of the supporting frame 201A set in advance. The inner guiding plate 290*a* was positioned relative to the intermediary transfer belt 216 by being abutted against a bearing 295 of the pre-secondary transfer roller 216*c* with respect to the feeding direction (arrow X direction) of the recording material S. Further, the inner guiding plate 290*a* is abutted toward the bearing 295 by an unshown spring or the like, and is fixed to the supporting frame 201A so as to be retractable in order not to interfere with the intermediary transfer unit 20 during mounting and dismounting of the intermediary transfer unit 20. Thus, the inner guiding plate 290*a* is fixed, so that in a region from the pre-secondary transfer roller 216*c* to the secondary transfer nip T2, the recording material S sent from the registration roller pair 270 is easily fed toward the secondary transfer nip T2 along the intermediary transfer belt 216.

Figure 2B:
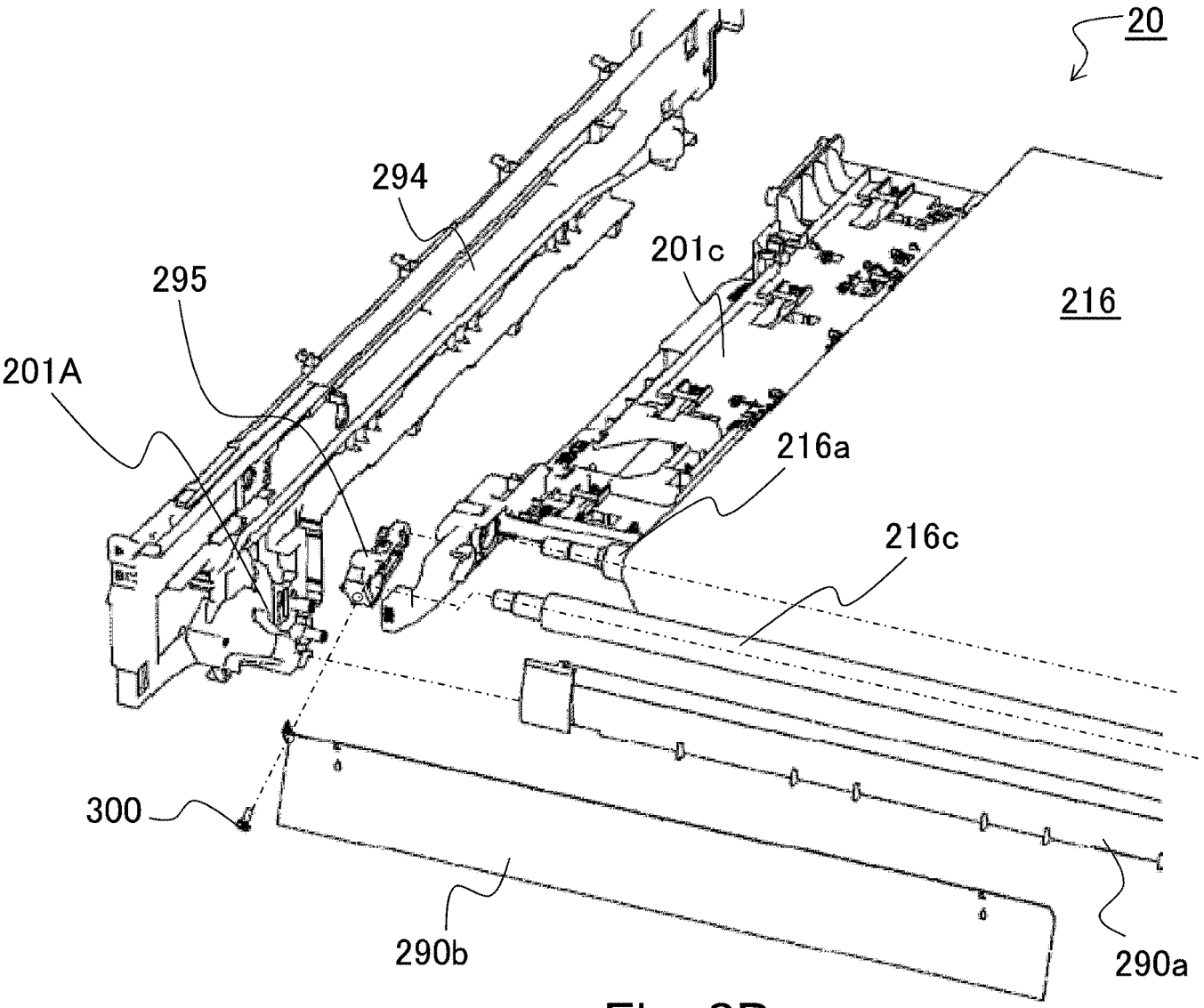
FIG. 2B is an exploded perspective view showing the outer guiding plate, the inner guiding plate, and the bearing in the first embodiment.

On the other hand, the outer guiding plate 290*b* is fixed to the bearing 295 which is an example of a holding portion as shown in FIGS. 2A and 2B. The outer guiding plate 290*b* is fixed to the bearing 295 with a screw 300 as a fastening member at opposite end portions with respect to the widthwise direction. Incidentally, in FIGS. 2A and 2B, as an example, only a fixing portion of the image forming apparatus 201 on the front side is shown. As regards a fixing portion of the image forming apparatus 201 on the rear side, a constitution thereof is similar to the constitution on the front side, and therefore, description will be omitted.

Figure 4:
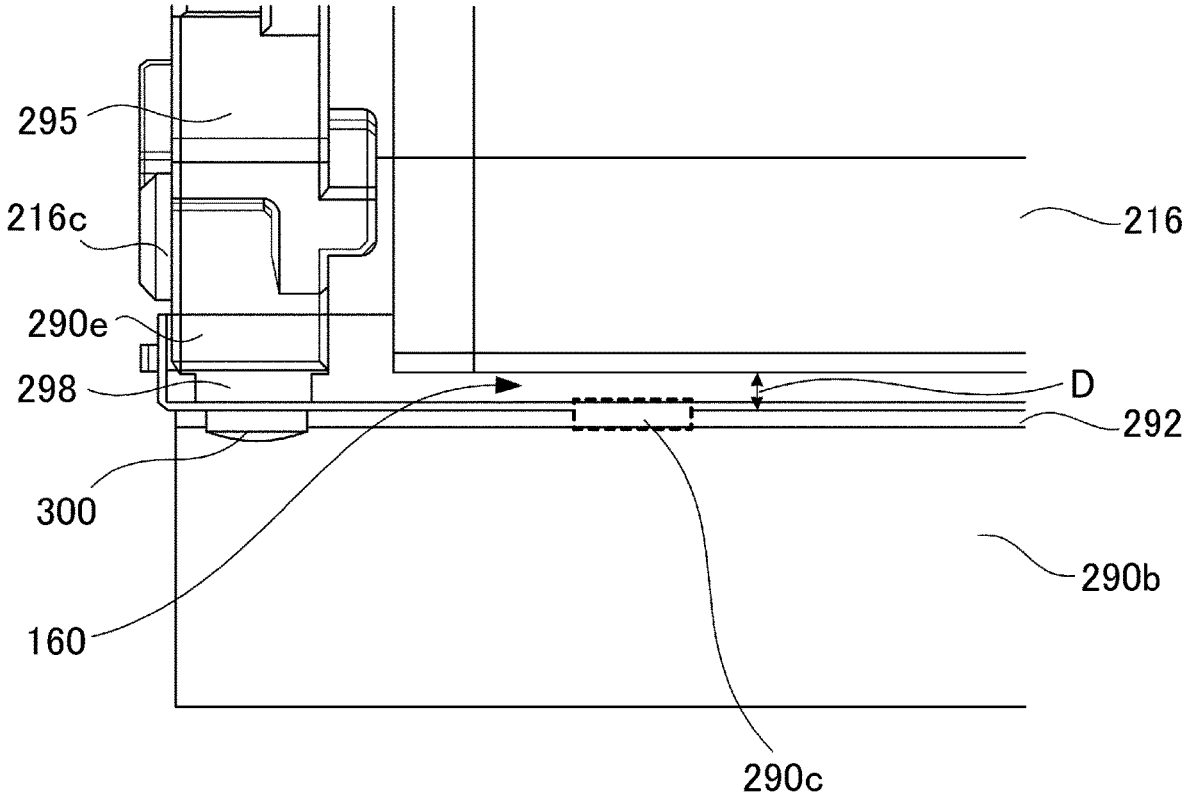
FIG. 4 is an enlarged view showing a fixing portion between the outer guiding plate and the bearing.

The outer guiding plate 290*b* is fixed to the bearing 295 at a position outside, a feeding region of the recording material S fed by the registration roller pair 270, in the rotational axis direction of the pre-secondary transfer roller 216*c*. In order to fix the outer guiding plate 290*b* with the screw 300, at each of opposite end portions outside a width of a feedable maximum-width recording material S, as shown in FIG. 4, the bearing 295 is provided with a fixing portion 290*e*. When the outer guiding plate 290*b* is fixed to the bearing 295, a feeding path 160 can be formed between itself and the intermediary transfer belt 216 with an interval D appropriate for toner image transfer at the downstream guiding portion 292 on a side downstream of the bent portion 297 (see FIG. 3) with respect to the feeding direction X.

Thus, by fixing the outer guiding plate 290*b* to the bearing 295 of the pre-secondary transfer roller 216*c* for stretching the intermediary transfer belt 216, at a position where the interval between the outer guiding plate 290*b* and the intermediary transfer belt 216 becomes the interval appropriate for the toner image transfer, the outer guiding plate 290*b* can be positioned and disposed. That is, by directly fixing the outer guiding plate 290*b* to the bearing 295 supporting the pre-secondary transfer roller 216*c*, the number of interposed members relating to positioning of these guiding plates can be reduced. Therefore, the influence of component tolerances on the positioning can be suppressed, so that the interval of the feeding path 160 formed by the outer guiding plate 290*b* and the intermediary transfer belt 216 can be set at the interval appropriate for the toner image transfer.

As in the above-described conventional example, when the outer guiding plate 290*b* is disposed relative to the intermediary transfer belt 216 via six or more component parts, even when the component tolerances can be suppressed to about "0.1 mm" which is possible minimum level in manufacturing, the interval of the feeding path 160 can cause a variation of about "0.6 mm". For example, it is preferable that in the feeding path 160, the interval at a narrowest position is "1.5 mm" (predetermined interval" and is constant with respect to the widthwise direction, but in the conventional example, for each image forming apparatus, a variation such that the interval is not constant in a range of "0.9 mm" to 2.1 mm" with respect to the widthwise direction occurred in some instances.

On the other hand, according to the above-described this embodiment, the variation in interval of the feeding path 160 formed by the outer guiding plate 290*b* and the intermediary transfer belt 216 can be suppressed to about "0.3 mm". As regards a minimum interval of the feeding path 150 is set in general at a narrow interval such as about "1.5 mm" in order to prevent the improper transfer, and therefore, when the variation in interval can be suppressed from the conventional "0.6 mm" to about "0.3 mm", a degree of contribution thereof is large. According to this embodiment, for example, in the case where it is desirable that the interval of the feeding path 160 at the narrowest position is "1.5 mm", the variation in interval can be suppressed to a range of "1.2 mm to 1.8 mm" for each of individual image forming apparatuses.

As described above, according to this embodiment, the outer guiding plate 290*b* is fixed to the bearing 295 of the pre-secondary transfer roller 216*c* for stretching the intermediary transfer belt 216. By doing so, at positions where the interval of the feeding path 160 formed between the outer guiding plate 290*b* and the intermediary transfer belt 216 is formed at the interval appropriate for the toner image transfer, the outer guiding plate 290*b* can be disposed relative to the intermediary transfer belt 216 with a simple constitution. By this, when the recording material S enters the secondary transfer nip T2, a phenomenon that the entrance angle with respect to the intermediary transfer belt 216 is not stabilized and that the recording material S flutters does not occur, and thus improper transfer of the toner image from the intermediary transfer belt 216 onto the recording material S does not readily occur. That is, it is possible to suppress that the outer guiding plate 290*b* is disposed in a position spaced from the stretching portion 293, by the influence of the tolerances due to intervention of many members, of the intermediary transfer belt 216 stretched by the pre-secondary transfer roller 216*c* and the inner secondary transfer roller 216*a*. Therefore, electric discharge generated by broadening of the interval between the outer guiding plate 290*b* and the intermediary transfer belt 216 can be suppressed, so that it is possible to suppress the occurrence of improper transfer such that the white void of the image occurs due to that a part of the image is not transferred onto the recording material S.

Incidentally, in order that the interval of the feeding path 160 (see FIG. 3) formed by the outer guiding plate 290*b* and the intermediary transfer belt 216 can be set with accuracy, it is preferable that the outer guiding plate 290*b* can be adjusted and fixed to the bearing 295. In order to do so, as shown in FIG. 4, a spring 298 as an urging member for urging the bearing 295 (specifically the fixing portion 290*e*) and the outer guiding plate 290*b* in a spacing direction may preferably be provided between the bearing 295 and the outer guiding plate 290*b*. In an example shown in FIG. 4, the spring 298 is disposed between of the outer guiding plate 290*b* and the fixing portion 290*e* and depending on a fastening degree of the screw 300, the interval of the feeding path 160 can be adjusted against an urging force of the spring 298.

Further, as described above, in the case where the interval of the feeding path 150 is made adjusted by the fastening degree of the screw 300, as shown in FIG. 2A, an opening 290*c* for measuring the interval may preferably be formed in the downstream guiding portion 292 of the outer guiding plate 290*b*. The opening 290*c* may preferably be formed in at least two positions of opposite end portions with respect to the widthwise direction than a center. By doing so, when the outer guiding plate 290*b* is assembled to the bearing 295, on each of the opposite end portion sides, the interval between the outer guiding plate 290*b* and the intermediary transfer belt 216 can be measured through the opening 290*c* by using an unshown distance-measuring sensor. Accordingly, the fastening degree of the screw 300 can be adjusted at each of the opposite end portions so that the interval with respect to the widthwise direction becomes the same, with the result that the outer guiding plate 290*b* and the intermediary transfer belt 216 are capable of being positioned so that the interval appropriate for the toner image transfer is formed.

Incidentally, in the above-described embodiment, an example in which the inner guiding plate 290*a* is disposed in a position set in advance in the supporting frame 201A was described, but the present invention is not limited thereto. For example, as shown in FIGS. 2A and 2B, the inner guiding plate 290*a* may also be fixed to the outer guiding plate 290*b* by the screw 300 or the like. By doing so, the inner guiding plate 290*a* can be easily disposed at a position where the interval of the feeding path 150 (see FIG. 3) formed between the inner guiding plate 290*a* and the outer guiding plate 290*b* is formed as the interval appropriate for the toner image transfer. By this, the interval (gap) with respect to the widthwise direction between the inner guiding plate 290*a* and the outer guiding plate 290*b* becomes different, and thus the sliding resistance of the feeding path (150, 160) with the recording material S is different between the front side and the rear side of the image forming apparatus 201, so that oblique movement of the fed recording material S can be suppressed. Further, thus, it is possible to suppress the oblique movement of the recording material S fed to the secondary transfer nip T2, and therefore, it is possible to suppress positional deviations (that the image is obliquely transferred and that a margin is not appropriately provided, and the like) with respect to the recording material S.

SECOND EMBODIMENT

Incidentally, in the image forming apparatus 201, a so-called jam such that the recording material S during the feeding is jammed at an intermediate portion of the feeding path during the image forming operation occurs in some instances. In the case where the jam occurs, the image forming apparatus 201 stops the feeding of the recording material S, but the recording material S stagnates in the feeding paths (150, 160, see FIG. 3) at that time in some instances. In such a case, there is a need to remove the stagnated recording material S. Therefore, in the case where the jam of the recording material S occurs, in order to permit removal of the recording material S by opening the feeding paths (150, 160), the outer guiding plate 290*b* is provided so as to be moved toward and away from the intermediary transfer belt 216 in some instances.

However, there is a need that the outer guiding plate 290*b* is disposed relative to the intermediary transfer belt 216 so as to form the interval appropriate for the toner image transfer between the outer guiding plate 290*b* and the intermediary transfer belt 216 in a state in which the outer guiding plate 290*b* is brought near to the intermediary transfer belt 216. A second embodiment for realizing such a constitution will be described using parts (a) and (b) of FIG. 5. Part (a) of FIG. 5 shows the case where the outer guiding plate 290*b* is in an open position relative to the intermediary transfer belt 216. Part (b) of FIG. 5 shows the case where the outer guiding plate 290*b* is in a closed position relative to the intermediary transfer belt 216.

As shown in parts (a) and (b) of FIG. 5, the outer guiding plate 290*b* is provided rotatably relative to the intermediary transfer belt 216 in such a state that an upstream portion on one end portion side with respect to the feeding direction is a rotation center 800 and a downstream portion on the other end portion side is a free end. In this embodiment, the outer guiding plate 290*b* is rotatably supported by an arm portion 810 formed at each of the opposite end portions of the inner guiding plate 290*a* with respect to the widthwise direction.

Then, on the free end side of the outer guiding plate 290*b*, in the case where the outer guiding plate 290*b* is in the closed position, an abutting portion 301 for providing an interval between the outer guiding plate 290*b* and the intermediary transfer belt 216 by being abutted against the bearing 295 is formed at each of the opposite end portions with respect to the widthwise direction. In the case where the outer guiding plate 290*b* is in the closed position, the abutting portion 301 is formed between the outer guiding plate 290*b* and the intermediary transfer belt 216 in a length such that the feeding path 160 (see FIG. 4) with the interval D appropriate for the toner image transfer.

By doing so, even after the outer guiding plate 290*b* is moved away from the intermediary transfer belt 216 and the recording material S is removed by opening the feeding paths (150, 160), the feeding path 150 with the interval appropriate for the toner image transfer can be immediately reproduced between the outer guiding plate 290*b* and the intermediary transfer belt 216. Incidentally, the abutting portion 301 is not limited to the case where the abutting portion 301 is formed on the outer guiding plate 90*b*, but may also be formed on the bearing 295.

Incidentally, the registration roller portion 270 is rotationally driven by an unshown motor, but a rotational direction thereof is restricted only to one direction by a mechanism (not shown) such as a one-way clutch, for example. Further, at an end of a roller shaft of the registration roller pair 270, a gripping member 302 is provided (see FIG. 2A). In the case where the jam occurs, when the registration roller pair 270 is manually rotated by an operator through the gripping member 302, the recording material S stagnated in the feeding paths (150, 160) is sent toward the downstream side with respect to the widthwise direction.

Thus, the operator can only pull out the recording material S, stagnated in the feeding paths (150, 160), from the downstream side with respect to the widthwise direction. By doing so, even when the toner image is transferred from the intermediary transfer belt 216 onto a part of the recording material S, a portion on which the toner image is transferred does not pass through the feeding paths (150, 160). That is, without contaminating the outer guiding plate 290*b* and the inner guiding plate 290*a* with the toner, the recording material S is removed from the feeding paths (150, 160).

Third Embodiment

Next, a third embodiment will be described. At the positions where the interval appropriate for the toner image transfer is formed, the outer guiding plate 290*b* and the inner guiding plate 290*a* are positioned in advance, and these guiding plates may also be integrally provided with the intermediary transfer unit. Such an intermediary transfer unit 20A will be described using FIGS. 6 to 8 while referring to FIGS. 1 and 3.

As shown in FIG. 6, the intermediary transfer unit 20A is provided so as to be capable of being inserted in and extracted from a supporting frame 201A. The intermediary transfer unit 20A is mounted in the supporting frame 201A by being slid and moved in a mounting direction (arrow Y direction) along intermediary transfer belt guiding rails 294 provided in the supporting frame 201A. The supporting frame 201A is provided with an openable (closable) portion 560 and in a state in which the door 400 (see FIG. 1) is opened, mounting and dismounting of the intermediary transfer unit 20A are capable of being performed. The intermediary transfer unit 20A is provided with a gripping portion 250, and the operator grips the gripping portion 250 and can easily slide and move the intermediary transfer unit 20A along the intermediary transfer belt guiding rails 294.

Incidentally, in this embodiment, a type in which the door 400 (see FIG. 1) provided on the side-surface side of the supporting frame 201A is opened and the intermediary transfer unit 20A is mounted in the supporting frame 201A by being slid and moved in the mounting direction (arrow Y direction) was described as an example, but the present invention is not limited thereto. For example, a type in which a front door 410 provided on the front side of the supporting frame 201A is opened and the intermediary transfer unit 20A is mounted in the supporting frame 201A by being slid and moved in a mounting direction (arrow Z direction) may also be employed.

The intermediary transfer unit 20A as a transfer means includes the intermediary transfer belt 216, the inner secondary transfer roller 216*a*, the tension roller 216*b*, the pre-secondary transfer roller 216*c*, the driving roller 216*d*, the plurality of primary transfer rollers 219 (see FIG. 1), a holding portion 201*c*, the inner guiding plate 290*a*, and the outer guiding plate 290*b*. This intermediary transfer unit 20A is provided so as to be capable of being inserted in and extracted from the supporting frame 201A (see FIG. 6) similarly as in the above-described first embodiment, so that in the case of this embodiment, when the intermediary transfer unit 20A is dismounted, the inner guiding plate 290*a* and the outer guiding plate 290*b* are removed together from the supporting frame 201A. Incidentally, also in the above-described first embodiment, a constitution in which the inner guiding plate 290*a* and the outer guiding plate 290*b* are included in the intermediary transfer unit 20 was described, but in this embodiment, a fixing structure between the inner guiding plate 290*a* and the outer guiding plate 290*b* is different from the fixing structure in the first embodiment.

As shown in FIG. 7, the outer guiding plate 290*b* is fixed to the holding portion 201*c* at each of the opposite end portions with respect to the widthwise direction so that the feeding path 160 (see FIG. 3) with the interval appropriate for the toner image transfer is formed between itself and the intermediary transfer belt 216. The inner guiding plate 290*a* is fixed to the holding portion 201*c* at each of opposite end portions with respect to the widthwise direction so that the feeding path 150 (see FIG. 3) is formed with the interval appropriate for the toner image transfer. For example, as shown in FIG. 8, at each of opposite end portions of the outer guiding plate 290*b*, a screw fastening portion 360 standing toward a side opposite from the feeding path 150 (see FIG. 3), and the outer guiding plate 290*b* is fixed by a fixing screw 305 from a side opposite from the screw fastening portion 360 while sandwiching the holding portion 201*c* therebetween. Incidentally, in FIG. 8, for convenience of illustration, although the inner guiding plate 290*a* is omitted, similarly as the outer guiding plate 290*b*, the inner guiding plate 290*a* is also provided with a screw fastening portion 360 at each of the opposite end portions, and is fixed by the fixing screw 305 from a side opposite from the screw fastening portion 360 while sandwiching the holding portion 201*c* therebetween.

Thus, in this embodiment, the inner guiding plate 290*a* and the outer guiding plate 290*b* are integrally provided as the intermediary transfer unit 20A. That is, the inner guiding plate 290*a* and the outer guiding plate 290*b* are fixed to the holding portion 201*c* for rotatably holding the inner secondary transfer roller 216*a*. Further, in the intermediary transfer unit 20A, each of the inner guiding plate 290*a* and the outer guiding plate 290*b* is fixed to the holding portion 201*c* which is a single component part at opposite end portions, so that the influence of component tolerances can be suppressed compared with the conventional example in which many component parts are interposed. Further, in this embodiment, at positions where the interval appropriate for the toner image transfer is formed between the inner guiding plate 290*a* and the outer guiding plate 290*b*, the inner guiding plate 290*a* and the outer guiding plate 290*b* are capable of being positioned and disposed. In addition, this embodiment is advantageous also in that a positional relationship between the inner guiding plate 290*a* and the outer guiding plate 290*b* is unchanged even when the intermediary transfer unit 20A is mounted and dismounted.

Incidentally, the inner guiding plate 290*a* is not limited to that the inner guiding plate 290*a* is fixed to the holding portion 201*c*, but may also be fixed to the outer guiding plate 290*b* by the screw 300 or the like. That is, as regards the intermediary transfer unit 20A, a constitution in which only the outer guiding plate 290*b* is fixed to the holding portion 201*c* and in which the inner guiding plate 290*a* can be separately mounted may also be employed.

According to the present invention, at a position where the interval appropriate for the toner image transfer is formed between the second guiding member and the image bearing belt which guide the recording material, onto which the toner image is to be transferred, to the secondary transfer nip, arrangement of the second guiding member relative to the image bearing belt can be realized by the simple constitution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2021-028188 filed on Feb. 25, 2021, and 2022-013257 filed on Jan. 31, 2022, which are hereby incorporated by reference herein in their entirety.

What is claimed is:

1. An image forming apparatus comprising:

an endless image bearing belt rotatable while bearing a toner image transferred from an image bearing member;

a first roller configured to stretch the image bearing belt;

a second roller provided on a side upstream of the first roller with respect to a rotational direction of the image bearing belt and configured to stretch the image bearing belt in cooperation with the first roller;

a rotatable member configured to form a transfer nip in which the toner image on the image bearing belt is transferred onto a recording material while nipping and feeding the recording material in cooperation with the first roller through the image bearing belt;

a holding member configured to rotatably hold the second roller at opposite end portions with respect to a rotational axis direction of the second roller;

a feeding unit configured to feed the recording material toward the transfer nip; and a guiding member that (i) is provided on a side downstream of the feeding unit and upstream of the transfer nip with respect to a recording material feeding direction at a position opposing a stretching portion stretched by the first roller and the second roller of the image bearing belt and (ii) is configured to guide the recording material fed by the feeding unit to the transfer nip, wherein the guiding member is fixed to the holding member.

2. An image forming apparatus according to claim 1, further comprising another guiding member that (i) is provided on a side downstream of the feeding unit and upstream of the transfer nip with respect to the recording material feeding direction at a position opposing the guiding member and (ii) is configured to guide, to the transfer nip, the recording material fed by the feeding unit, wherein the guiding member includes a first opposing portion that opposes the another guiding member with an interval and includes a second opposing portion that is provided on a side downstream of the first opposing portion with respect to the recording material feeding direction, which is continuous to the first opposing portion, and which opposes the image bearing belt with an interval.

3. An image forming apparatus according to claim 2, further comprising a fastening member configured to fix the guiding member to the holding member, wherein the guiding member is fixed to the holding member so that the interval between the second opposing portion and the image bearing belt is adjustable by the fastening member.

4. An image forming apparatus according to claim 3, further comprising an urging member configured to urge the guiding member so that the guiding member is spaced from the holding member, wherein the fastening member is a screw capable of adjusting the interval between the second opposing portion and the guiding member against an urging force of the urging member.

5. An image forming apparatus according to claim 3, wherein the guiding member is provided with openings formed in the second opposing portion in at least two positions on opposite end portion sides from a center with respect to a rotational axis direction of the second roller.

6. An image forming apparatus according to claim 2, wherein the another guiding member is fixed to the holding member so as to form a recording material feeding path with an interval between itself and the guiding member.

7. An image forming apparatus according to claim 1, wherein the guiding member is fixed to the holding member at a position outside a feeding region, in which the recording material is fed, with respect to a rotational axis direction of the second roller.

8. An image forming apparatus according to claim 1, wherein the image bearing member is a photosensitive member configured to transfer the toner image onto the image bearing belt, and wherein the image forming apparatus further comprises:

(1) the photosensitive member;

(2) a supporting frame configured to support the photosensitive member;

(3) a transfer unit including the image bearing belt, the first roller, the second roller, the rotatable member, the holding member, the guiding member, and another guiding member, the transfer unit being capable of being inserted in and extracted from the supporting frame; and (4) a guiding rail provided on the supporting frame and configured to slidably guide the transfer unit.

9. An image forming apparatus according to claim 8, further comprising a door provided rotatable relative to the supporting frame, wherein the transfer unit is capable of being inserted in and extracted from the supporting frame by opening of the door relative to the supporting frame.

10. An image forming apparatus according to claim 9, wherein the door rotatably supports the rotatable member.

* * * * *